US006786339B2

(12) United States Patent
Deiss et al.

(10) Patent No.: US 6,786,339 B2
(45) Date of Patent: Sep. 7, 2004

(54) DISH RACK FOR DISHWASHER

(75) Inventors: Ulrich Deiss, Sontheim (DE); Gerhard Fetzer, Gundelfingen (DE); Thomas Ott, Gundelfingen (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/174,097

(22) Filed: Jun. 17, 2002

(65) Prior Publication Data

US 2003/0057166 A1 Mar. 27, 2003

Related U.S. Application Data

(63) Continuation of application No. PCT/EP00/10812, filed on Nov. 2, 2000.

(30) Foreign Application Priority Data

Dec. 16, 1999 (DE) ..... 199 60 810

(51) Int. Cl.[7] ..... A47G 19/08
(52) U.S. Cl. ..... 211/41.8
(58) Field of Search ..... 211/41.8, 181.1, 211/41.3, 41.4, 41.9, 41.18, 46, 126.1, 126.9, 127.1, 133.5; 206/71 C, 454, 832; D32/3, 55–59; 134/201, 135, 57 D, 56 D, 144, 145, 148, 163, 200

(56) References Cited

U.S. PATENT DOCUMENTS

| | | | | | |
|---|---|---|---|---|---|
| 415,634 | A | * | 11/1889 | Guptill | 211/41.4 |
| 946,977 | A | * | 1/1910 | Muller | 211/41.6 |
| 1,285,000 | A | * | 11/1918 | Blakeslee | 220/572 |
| 1,345,401 | A | * | 7/1920 | Ratner | 220/572 |
| 1,360,192 | A | * | 11/1920 | Davidson | 211/41.8 |
| 1,371,253 | A | * | 3/1921 | Lynch | 220/572 |
| 1,477,903 | A | | 12/1923 | Rosenbaum | |
| 1,480,043 | A | * | 1/1924 | Blakeslee | 134/182 |
| 1,608,602 | A | * | 11/1926 | Lemex et al. | 134/201 |
| 1,637,376 | A | * | 8/1927 | Gibney | 134/56 D |
| 1,863,914 | A | * | 6/1932 | Tyler | 239/122 |
| 2,407,533 | A | | 9/1946 | Brock | |
| 2,433,823 | A | | 12/1947 | Lindeblad | |
| 2,443,404 | A | * | 6/1948 | Tallarico | 211/41.4 |
| 2,635,760 | A | * | 4/1953 | Nicholas | 211/41.8 |
| 2,832,499 | A | | 4/1958 | Maslow | |
| 2,997,155 | A | | 8/1961 | Muckler et al. | |
| 3,433,363 | A | * | 3/1969 | Clearman et al. | 211/41.8 |
| 3,752,322 | A | | 8/1973 | Fiocca et al. | |
| 3,934,822 | A | * | 1/1976 | Ross | 134/100 |
| 4,064,887 | A | * | 12/1977 | Geiger et al. | 134/144 |
| 4,420,005 | A | * | 12/1983 | Armstrong | 134/100 |
| 4,423,561 | A | | 1/1984 | Cartabbia | |

(List continued on next page.)

FOREIGN PATENT DOCUMENTS

| | | |
|---|---|---|
| CH | 273905 | 7/1951 |
| CH | 487 637 | 3/1970 |
| DE | 1 403 633 | 10/1968 |
| DE | 7207210 | 5/1972 |

(List continued on next page.)

*Primary Examiner*—Jennifer E. Novosad
(74) *Attorney, Agent, or Firm*—Laurence A. Greenberg; Werner H. Stemer; Ralph E. Locher

(57) ABSTRACT

A pull-out dish rack with a basic rack containing a wire framework for a dishwasher. The basic rack has a U-shaped construction and is fitted with at least a front or rear rack wall connected releasably to the basic rack, as seen by a user who is loading the dish rack with items which are to be washed. Additional parts, which accommodate a variety of items to be washed, can be fitted to accommodating devices on the front and/or rear walls. The additional parts may be adjustable and may include retaining elements for tall items or plates to be washed, and a spray device for use in subjecting items to be washed to an action of a cleaning liquid.

9 Claims, 1 Drawing Sheet

U.S. PATENT DOCUMENTS

| | | | | | |
|---|---|---|---|---|---|
| 4,593,822 | A | * | 6/1986 | Yeaney et al. | 211/41.8 |
| 4,742,836 | A | * | 5/1988 | Buehler | 134/182 |
| 4,804,006 | A | * | 2/1989 | Shaw | 134/177 |
| 5,332,105 | A | * | 7/1994 | Stanfield | 211/41.4 |
| 5,480,035 | A | * | 1/1996 | Smith | 211/41.8 |
| 5,601,195 | A | | 2/1997 | Finola et al. | |
| 5,649,630 | A | * | 7/1997 | Remmler | 211/41.8 |
| 6,012,593 | A | * | 1/2000 | Knittel et al. | 211/41.11 |
| D439,716 | S | * | 3/2001 | Wright | D32/55 |
| 6,386,096 | B1 | * | 5/2002 | Tiemann | 99/426 |
| 6,431,188 | B1 | * | 8/2002 | Laszczewski et al. | 134/56 D |

FOREIGN PATENT DOCUMENTS

| | | | | | |
|---|---|---|---|---|---|
| DE | 7228949 | | | 9/1972 | |
| DE | 2 232 483 | | | 1/1973 | |
| DE | 7301351 | | | 4/1973 | |
| DE | 6610563 | | | 9/1974 | |
| DE | 31 30 637 | A1 | | 5/1982 | |
| DE | 31 35 458 | A1 | | 3/1983 | |
| DE | 85 29 820.4 | U1 | | 5/1986 | |
| DE | 295 05 325.9 | U1 | | 7/1995 | |
| DE | 295 14 900 | U1 | | 2/1996 | |
| DE | 297 14 515 | U1 | | 12/1997 | |
| DE | 1199025 | A1 | * | 10/2001 | 211/41.8 |
| EP | 0 143 754 | A1 | | 6/1985 | |
| EP | 0 648 463 | A1 | | 4/1995 | |
| EP | 0 898 929 | A1 | | 3/1999 | |
| FR | 1 177 662 | | | 4/1959 | |
| FR | 2 077 852 | | | 11/1971 | |
| FR | 2 544 606 | | | 10/1984 | |
| GB | 1085100 | | | 9/1967 | |

* cited by examiner

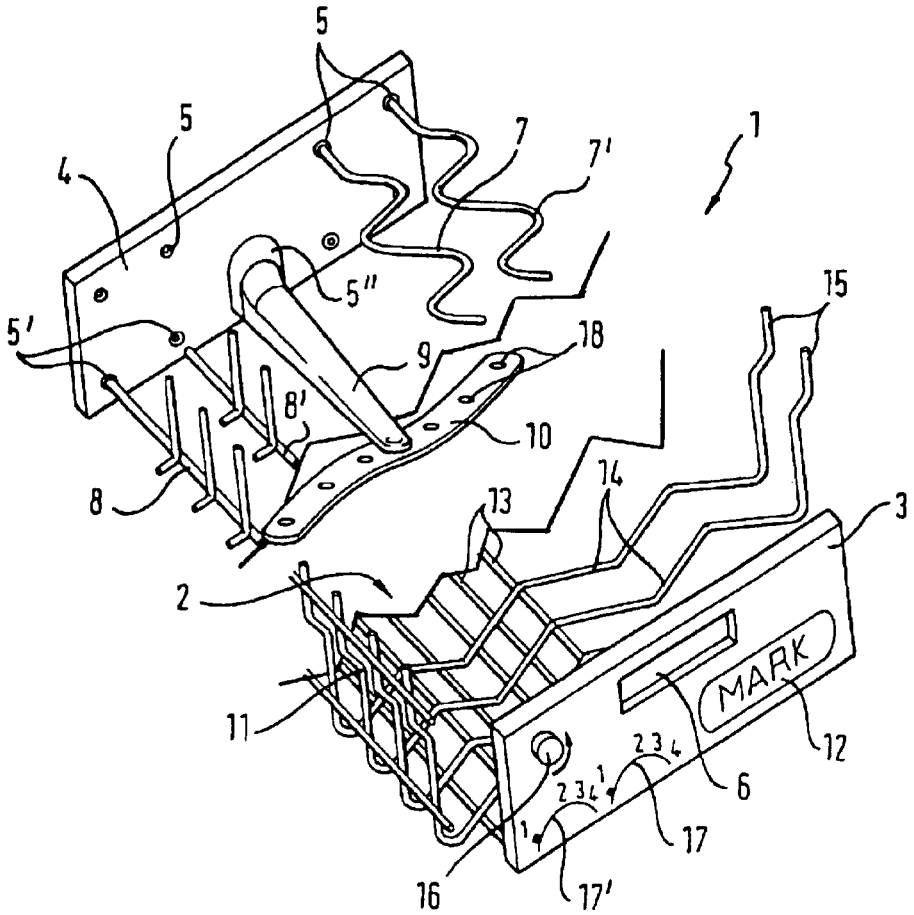
5
5
4
7
7'
1
5''
5'
9
18
15
8'
10
8
13
14
3
2
MARK
11
12
6
17
16
17'

DISH RACK FOR DISHWASHER

CROSS-REFERENCE TO RELATED APPLICATION

This application is a continuation of copending International Application No. PCT/EP00/10812, filed Nov. 2, 2000, which designated the United States and was not published in English.

BACKGROUND OF THE INVENTION

Field of the Invention

The invention relates to a dishwasher having at least one pull-out dish rack which is intended for accommodating items which are to be washed and has a basic rack containing a wire framework.

It is generally known for one or two pull-out dish racks for accommodating items which are to be washed—e.g. pieces of crockery such as plates, cups, glasses, cutlery, etc.—to be disposed in a dishwashing compartment of a dishwasher. Published, European Patent Application EP 0 143 754 A1 discloses a dishwasher with two dish racks which are intended for accommodating items which are to be washed and each have a U-shaped basic rack. Different additional elements may be coupled solely to the end side of the basic rack via snap-connection closures in order for it to be possible for the dish rack, containing the basic rack and variable end element, to be adapted, irrespective of its installation location, to the size and the construction of the dishwashing compartment.

SUMMARY OF THE INVENTION

It is accordingly an object of the invention to provide a dishwasher that overcomes the above-mentioned disadvantages of the prior art devices of this general type, which has a dish rack that is of a straightforward construction and may be configured in a flexible manner.

With the foregoing and other objects in view there is provided, in accordance with the invention, a dishwasher. The dishwasher contains at least one pull-out dish rack for accommodating items to be washed. The pull-out dish rack has a basic rack with a wire framework and at least one rack wall connected releasably to the basic rack. And, as seen by a user loading the pull-out dish rack with the items to be washed, the rack wall is fitted on the basic rack as a front wall or a rear wall.

Taking as the departure point a dish rack with the basic rack containing the wire framework, at least one rack wall, in accordance with the subject matter of the invention, is connected releasably to the basic rack and, as seen by a user who is loading the dish rack with items which are to be washed, is fitted on the basic rack as the front wall or as the rear wall. This gives a dish-rack structure which allows, on the one hand, the straightforward construction of the basic rack—preferably in the form of a U—and, on the other hand, the releasable fastening of rack walls—a wide variety of different configuration and embodiments—on the front and rear walls. The advantages in comparison with a conventional dish rack are the lower production outlay and, in particular, the flexibility in configuring the dish rack for accommodating a wide variety of different items which are to be washed, in particular by the introduction of different additional parts into the dish rack, the additional parts being fitted on the rear wall and/or front wall in each case in accommodating devices. Further advantages of the dish rack configured according to the invention reside in the fact that the transporting volume and the storage volume of the individual dish-rack elements are minimized.

The additional parts can be integrated relatively straightforwardly in the dish rack, on the front and/or rear walls, while there is a simultaneous increase in the number of construction-related and configuration variants of the dish rack as a whole. Easier brand differentiation from other products and an improvement in the ease of operation for the user are further advantages of the dish rack configured according to the invention.

It has proven particularly favorable here for the rear wall and/or the front wall to have accommodating devices for the additional parts. According to further configurations of the invention, such additional parts may contain an adjusting element for adjusting a pivoting spike configuration, a grip element, a retaining element for tall items which are to be washed, at least two retaining elements for plate-shaped items which are to be washed, a design or ornamental part and a feed device for a spray device for subjecting the items which are to be washed to the action of a cleaning liquid.

As far as the low production outlay is concerned, it is particularly advantageous for the front and/or rear wall to be in the form of plastic parts.

Other features which are considered as characteristic for the invention are set forth in the appended claims.

Although the invention is illustrated and described herein as embodied in a dishwasher, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a perspective view of a dish rack for a dishwasher according to the invention.

DESCRIPTION OF THE PREFERRED EMBODIMENTS

Referring to the single FIGURE in detail thereof, there is shown a dishwashing compartment of a dishwasher for accommodating items which are to be washed—preferably pieces of crockery such as cups, saucers, plates and/or pieces of cutlery—it being possible for the dishwashing compartment to be closed by a door. The items that are to be washed are usually disposed in two pull-out dish racks and a separate cutlery box, of which part of one dish rack 1 is illustrated in the present example. The invention can be used both in a top rack and in a bottom rack. The dish rack 1 contains a basic rack 2, preferably in the form of a U, and two rack walls 3 and 4 which are fitted releasably on a front and rear of the basic rack 2—as seen by a user who is loading the dish rack 1 with items which are to be washed. The basic rack 2, which contains a wire framework having bent longitudinal and transverse struts 13, 14 as well as upright struts 15 on the side, is fastened on the front wall 3. Illustrated separately therefrom is the rear wall 4, which is connected to the wire framework of the basic rack 2. On account of more straightforward production and of more individual and improved configuration possibilities, the rear and front rack walls 3, 4 are produced from plastic parts.

The releasable fastening of the front and/or rear walls 3, 4 on the basic rack 2 takes place on the inside of the latter in each case. Thus, for example, the longitudinal struts 13 of the basic rack 2 latch releasably in accommodating devices, preferably latching holes, these not being visible on account of the perspective illustration. Further accommodating devices serve for the releasable fastening of additional parts—basically of any desired configuration—of which an adjusting element 11 is shown for adjusting a pivoting spike configuration, which can be pivoted between a horizontal position—in order for the dish rack to be loaded with pots and the like—and a vertical position—in order for it to be loaded with plates and the like. This allows the dish rack 1 to be configured in a flexible manner in terms of construction and functioning. Further advantages of the dish rack 1 configured according to the invention reside in the fact that the transporting volume and the storage volume of the individual dish-rack elements are minimized. Known additional parts, e.g. in the form of a rotary switch 16 and a plurality of indicators 17, 17', are provided on an end side of the front wall 3. It is also possible for a monogram 12 or the like to be fitted individually on the front wall 3 in order to promote the individual appearance of the front view. A grip element 6 assists in the operation of connecting the front wall 3 to the basic rack 2, or releasing it therefrom, with a low level of force being applied. Overall, the front wall 3 releasably connected to the basic rack 2 can be configured in an individual manner and can be replaced easily and quickly by being exchanged for a differently configured front wall 3. Easier brand differentiation is expediently possible by way of the shape, color, printing and the contents of the front wall 3. Furthermore, the latter also ensures that the dish rack 1 as a whole is stabilized. The basic rack 2, which essentially contains the wire framework, is preferably clipped into the front wall 3 and into the rear wall 4 and can be configured in a variety of different ways using additional insert parts.

It is also the case that the rear wall 4 has accommodating devices 5', 5 for additional parts to be fitted in a releasable manner, preferably on the inside of the rack wall. The accommodating devices 5', 5 form bearings for different additional parts. Thus, two retaining elements 7, 7' which are bent in serpentine form are disposed, for example, on the top right-hand border of the rear wall 4 for the purpose of accommodating tall items which are to be washed—preferably glasses, champagne flutes, beer glasses and the like—are latched releasably in parallel in the accomodating devices 5. A further additional part of the rear wall 4, latched in at the bottom left-hand border of the inside of the rear wall, contains at least two retaining elements 8, 8' which form parallel rows of spikes, containing spikes located in each case approximately at an angle of 90 degrees in relation to the longitudinal struts of the rack base, for accommodating plate-like items which are to be washed, such as saucers, soup dishes, plates and the like. It is also possible for an additional part of the rear wall 4 to contain a design part—if appropriate without any functional importance for maximum loading of the dishes rack 1.

A design part which forms an additional part of the rear wall 4 and also, at the same time, performs a dish-rack-specific function is constituted by a feed device 9 for a spray device 10 with spray holes 18 for subjecting the items which are to be washed, and are loaded in the dish rack, to the action of a cleaning liquid. The feed device 9, which is integrated in the rear wall 4 and fastened releasably on the inside of the rear wall, is T-shaped and contains a piston-like crosspiece which latches into a specific, relatively large accommodating device 5" as well as a thin metal plate, which is fitted at the end of the crosspiece, is bent preferably somewhat in undulating form and contains the spray holes 18. This results in a propeller-like part for routing and branching the liquid for cleaning the items that are to be washed.

We claim:

1. A rack for a dishwasher, comprising:

at least one pull-out dish rack for accommodating items to be washed, said pull-out dish rack having a basic rack with a wire framework, at least one rack wall having an inside surface and being releasably connected to said basic rack for connecting and releasing said basic rack from said at least one rack wall with force being applied thereto, additional parts for accommodating items to be washed, said at least one rack wall having accommodating devices for receiving said additional parts, said additional parts being releasably fitted in said accommodating devices and, when viewed in a direction in which items to be washed are loaded onto said pull-out dish rack, said at least one rack wall being fitted on said basic rack as one of a front wall and a rear wall, a feed device releasably engaging one of said accommodating devices on said inside surface of said at least one rack wall; and a spray device extending from said feed device for subjecting the items to be washed to an action of a cleaning liquid.

2. The rack according to claim 1, wherein said additional parts include a pivoting spike configuration element and an element for adjusting said pivoting spike configuration element being connected to said front wall.

3. The rack according to claim 1, wherein said front wall contains a grip element.

4. The rack according to claim 1, further comprising retaining element engaging one of said accommodating devices of said at least one rack wall, said retaining element being constructed and disposed to accommodate certain items to be washed.

5. The rack according to claim 1, further comprising at least two retaining elements engaging said accommodating devices of said at least one rack wall, said at least two retaining elements being constructed and disposed to accommodate plate-shaped items to be washed.

6. The rack according to claim 1, wherein said rear wall contains a part releasably fastened thereto for mounting a spray device.

7. The rack according to claim 1, wherein said basic rack has two sides with upright edges, and said basic rack is releasably mounted with respect to at least one of said rear wall and said front wall.

8. The rack according to claim 1, wherein said basic rack has additional insert parts for accommodating the items to be washed.

9. The rack according to claim 1, wherein said at least one rack wall is a plastic part.

* * * * *